US012752174B2

(12) United States Patent
Littles

(10) Patent No.: US 12,752,174 B2
(45) Date of Patent: Oct. 6, 2026

(54) PROXIMITY BASED GAME PLAYING ASSEMBLY AND METHOD OF USE

(71) Applicant: Carl Littles, Los Angeles, CA (US)

(72) Inventor: Carl Littles, Los Angeles, CA (US)

( * ) Notice: Subject to any disclaimer, the term of this patent is extended or adjusted under 35 U.S.C. 154(b) by 706 days.

(21) Appl. No.: 18/097,838

(22) Filed: Jan. 17, 2023

(65) Prior Publication Data

US 2024/0238665 A1 Jul. 18, 2024

(51) Int. Cl.
*A63B 71/06* (2006.01)

(52) U.S. Cl.
CPC .. *A63B 71/0622* (2013.01); *A63B 2071/0625* (2013.01)

(58) Field of Classification Search
CPC ..... A63B 71/0622; A63B 2071/0625; A63B 2220/12; A63B 2220/836; A63B 2225/54; A63B 2225/50; A63B 2220/40; A63B 2220/833; A63B 2024/0028; A63B 2024/0025; A63B 24/0021; A63B 2243/0025; A63B 2220/13; A63B 43/00; A63B 24/0062; A61B 5/681; A61B 5/1112
See application file for complete search history.

(56) References Cited

U.S. PATENT DOCUMENTS 4,961,575 A 10/1990 Perry
7,004,469 B2 2/2006 von Goeben
8,196,930 B2 6/2012 Bakshi
8,257,177 B1 * 9/2012 Saund ..... A63F 13/31 463/40
8,353,791 B2 * 1/2013 Holthouse ..... A63B 24/0062 463/40
D677,190 S 3/2013 Cobbett
8,574,049 B1 * 11/2013 Ackerman ..... G01S 5/0027 463/7
8,798,647 B1 * 8/2014 Haney ..... H04W 64/00 455/456.3
9,977,114 B1 * 5/2018 Hebert ..... G01S 13/74
10,406,427 B1 9/2019 White
2006/0189386 A1 * 8/2006 Rosenberg ..... A63F 13/12 463/37
2007/0026919 A1 2/2007 Klitsner
2007/0178967 A1 * 8/2007 Rosenberg ..... A63B 24/0087 463/39

(Continued)

FOREIGN PATENT DOCUMENTS

WO WO2005011827 2/2005

*Primary Examiner* — Ankit B Doshi

(57) ABSTRACT

A proximity based game playing assembly includes a plurality of watches, each having a band to which is attached a housing and which attaches to a wrist of a respective user of a plurality of users. Each watch comprises a receiver, which is Global Positioning System (GPS) enabled, a transceiver, which can wireless pair with an electronic device of the respective user, a microprocessor, and a notification module, that latter of which can notify the respective user of at least one aspect of a proximity based game. Programming code positionable on the electronic device of each user enables the electronic device to receive the GPS coordinates for, and to calculate distances between, the watches. The programming code also enables the electronic device to determine an outcome based on one or more of the distances and to signal the notification modules to notify the users of the outcome.

15 Claims, 5 Drawing Sheets

(56) References Cited

U.S. PATENT DOCUMENTS

| | | | | |
|---|---|---|---|---|
| 2010/0144455 | A1* | 6/2010 | Ahern | A63B 69/3623 700/92 |
| 2010/0144456 | A1* | 6/2010 | Ahern | A63B 57/00 700/92 |
| 2010/0184564 | A1* | 7/2010 | Molyneux | A43B 5/02 482/1 |
| 2011/0304497 | A1* | 12/2011 | Molyneux | A63B 24/0062 342/42 |
| 2013/0130843 | A1* | 5/2013 | Burroughs | H01Q 1/273 473/415 |
| 2014/0142459 | A1* | 5/2014 | Jayalth | A61B 5/0004 600/547 |
| 2014/0316305 | A1* | 10/2014 | Venkatraman | G01S 19/49 600/595 |
| 2015/0332031 | A1* | 11/2015 | Mistry | H04W 12/06 726/19 |
| 2016/0150978 | A1* | 6/2016 | Yuen | A61B 5/0205 600/301 |
| 2017/0319909 | A1* | 11/2017 | Freeman | A01K 15/025 |
| 2018/0260064 | A1* | 9/2018 | Chae | G06F 3/011 |
| 2018/0307333 | A1* | 10/2018 | Lim | G04R 20/02 |
| 2019/0089392 | A1* | 3/2019 | Altman | H04B 1/385 |
| 2020/0074838 | A1* | 3/2020 | Yalamachili | G08B 21/0269 |
| 2020/0196920 | A1* | 6/2020 | Vaddiraju | A61B 5/0022 |
| 2022/0151207 | A1* | 5/2022 | Mott | G06F 1/3231 |
| 2023/0098445 | A1* | 3/2023 | Leonhardt | G08B 21/0288 340/573.1 |
| 2024/0074703 | A1* | 3/2024 | Habib | A61B 5/681 |
| 2024/0207682 | A1* | 6/2024 | Matsimanis | A61B 5/1123 |

* cited by examiner

PROXIMITY BASED GAME PLAYING ASSEMBLY AND METHOD OF USE

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to game playing assemblies and more particularly pertains to a new game playing assembly for entertainment purposes. The present invention discloses a game playing assembly comprising a plurality of watches, each having a Global Positioning System enabled receiver that allows for proximity determination and a notification module that allows a user to monitor outcomes of a proximity based game.

(2) Description of Related Art Including Information Disclosed Under 37 CFR 1.97 and 1.98

The prior art relates to game playing assemblies, which may comprise a plurality of watches with signaling capability to assist in locating a user, watches with touch sensors to assess contact with another user, and a plurality of bracelets, wherein each bracelet communicates directly with all the other bracelets. What is lacking in the prior art is a game playing assembly comprising a plurality of watches, each having a Global Positioning System enabled receiver, which allows for outcomes of a proximity based game to be determined by distance of one user to another, and a notification module, which allows a user to monitor outcomes of a proximity based game.

(h) BRIEF SUMMARY OF THE INVENTION

An embodiment of the disclosure meets the needs presented above by generally comprising a plurality of watches. Each watch comprises a band, to which is attached a housing that defines an interior space. The band is configured to attach the watch to a wrist of a respective user of a plurality of users who are participating in a proximity based game. A receiver, which is Global Positioning System (GPS) enabled, a transceiver, which is configured for wireless pairing with an electronic device in possession of the respective user, and a microprocessor are attached to the housing and are positioned in the interior space. A notification module is attached to the housing and is configured to notify the respective user of at least one aspect of the proximity based game. The microprocessor is operationally engaged to the receiver, the transceiver, and the notification module. Programming code, which is selectively positionable on the electronic device of each user, enables the electronic device to receive the GPS coordinates for, and to calculate distances between, the watches of the users. The programming code also enables the electronic device to determine an outcome based on one or more of the distances, and to signal the notification modules to notify the users of the outcome.

An embodiment of the disclosure includes a proximity based game playing system, which comprises a plurality of watches, as described above, and a network server. Programming code is positioned on the network server and is selectively transmittable to the electronic device of each user. The programming code enables the electronic device to receive the GPS coordinates for, and to calculate distances between, the watches of the users, to determine an outcome based on one or more of the distances, and to signal the notification modules to notify the users of the outcome.

Yet another embodiment of the disclosure includes a method of playing a proximity based game, which comprises a provision step that entails providing a proximity based game playing assembly, according to the disclosure above. Setup steps are installing the programming code on each user's electronic device, attaching the watches to the wrists of the users, and wirelessly pairing each watch to its associated electronic device. Use steps are engaging in a proximity based game and monitoring progress of the game via the notification module.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
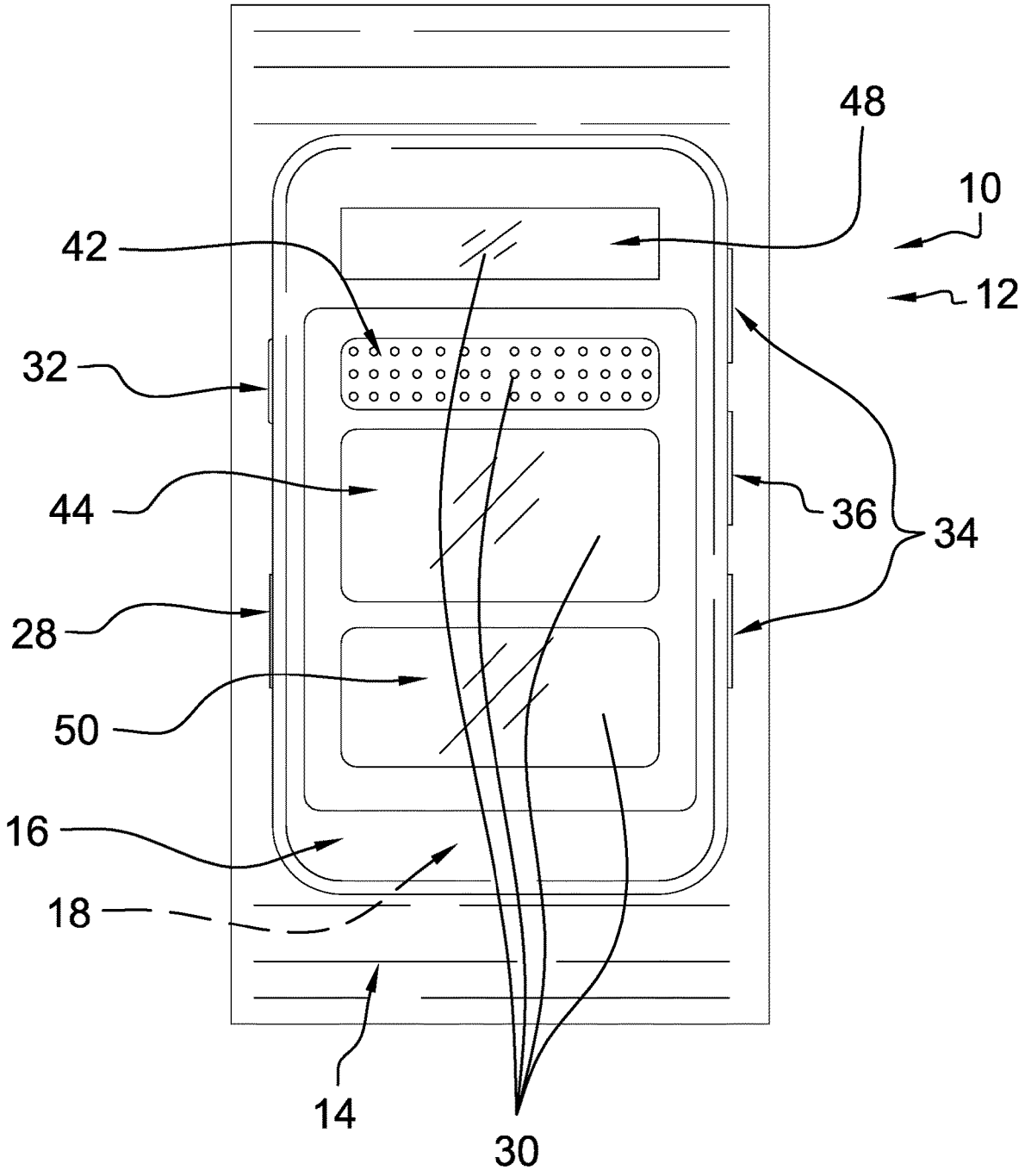
FIG. 1 is a front view of a proximity based game playing assembly according to an embodiment of the disclosure.
Figure 2:
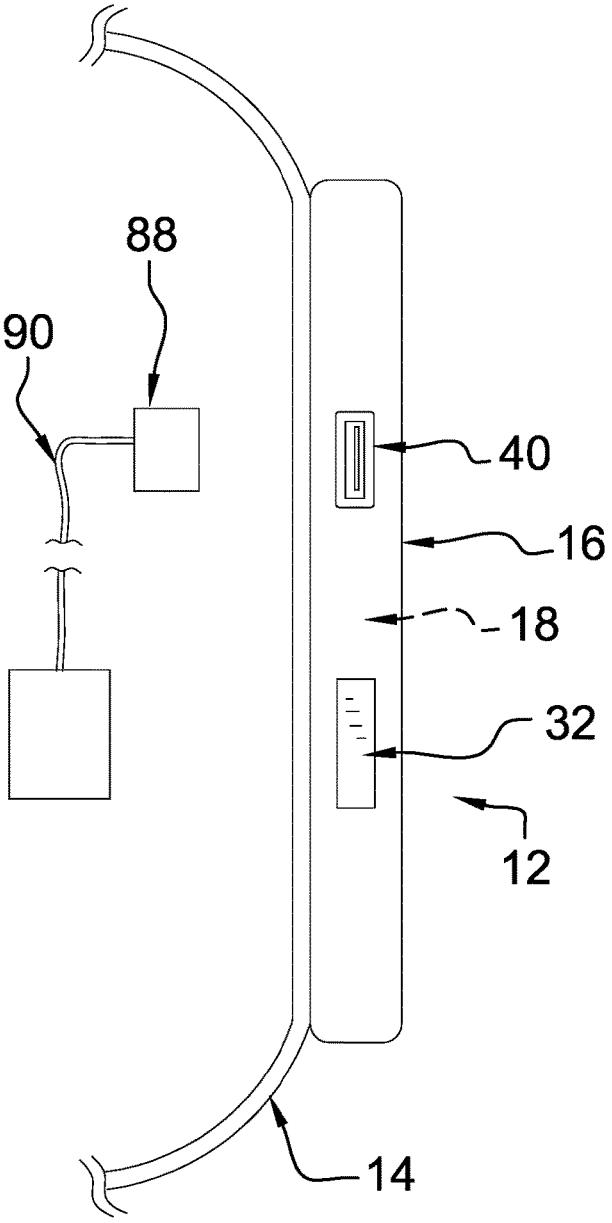
FIG. 2 is a first side view of an embodiment of the disclosure.
Figure 3:
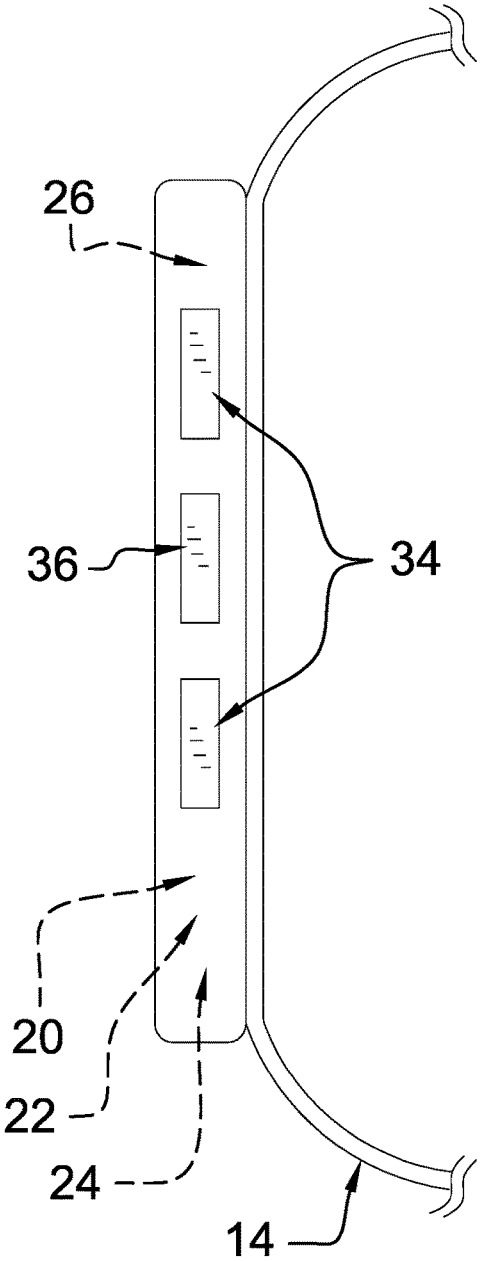
FIG. 3 is a second side view of an embodiment of the disclosure.
Figure 4:
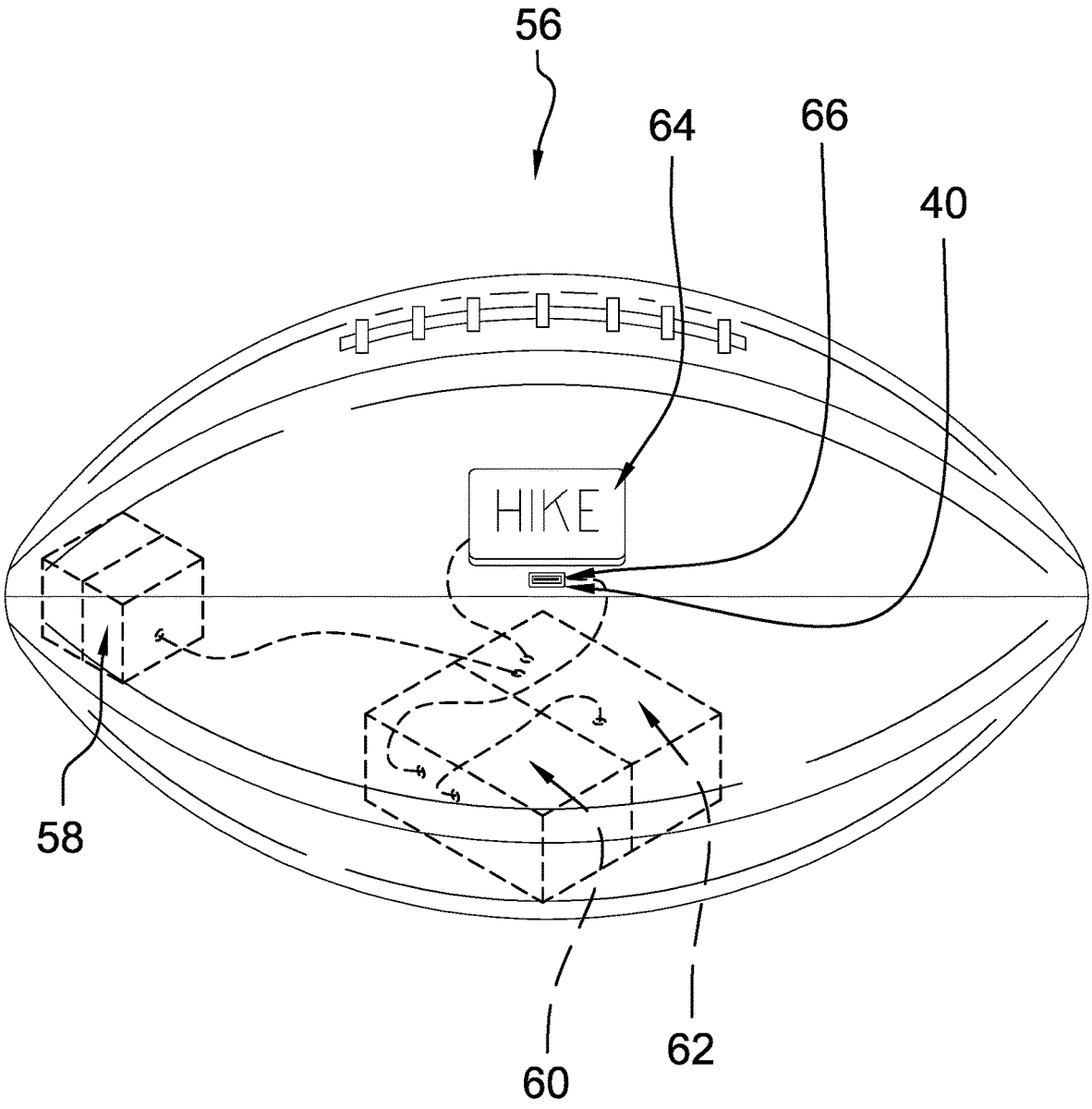
FIG. 4 is a detail view of an embodiment of the disclosure.
Figure 5:
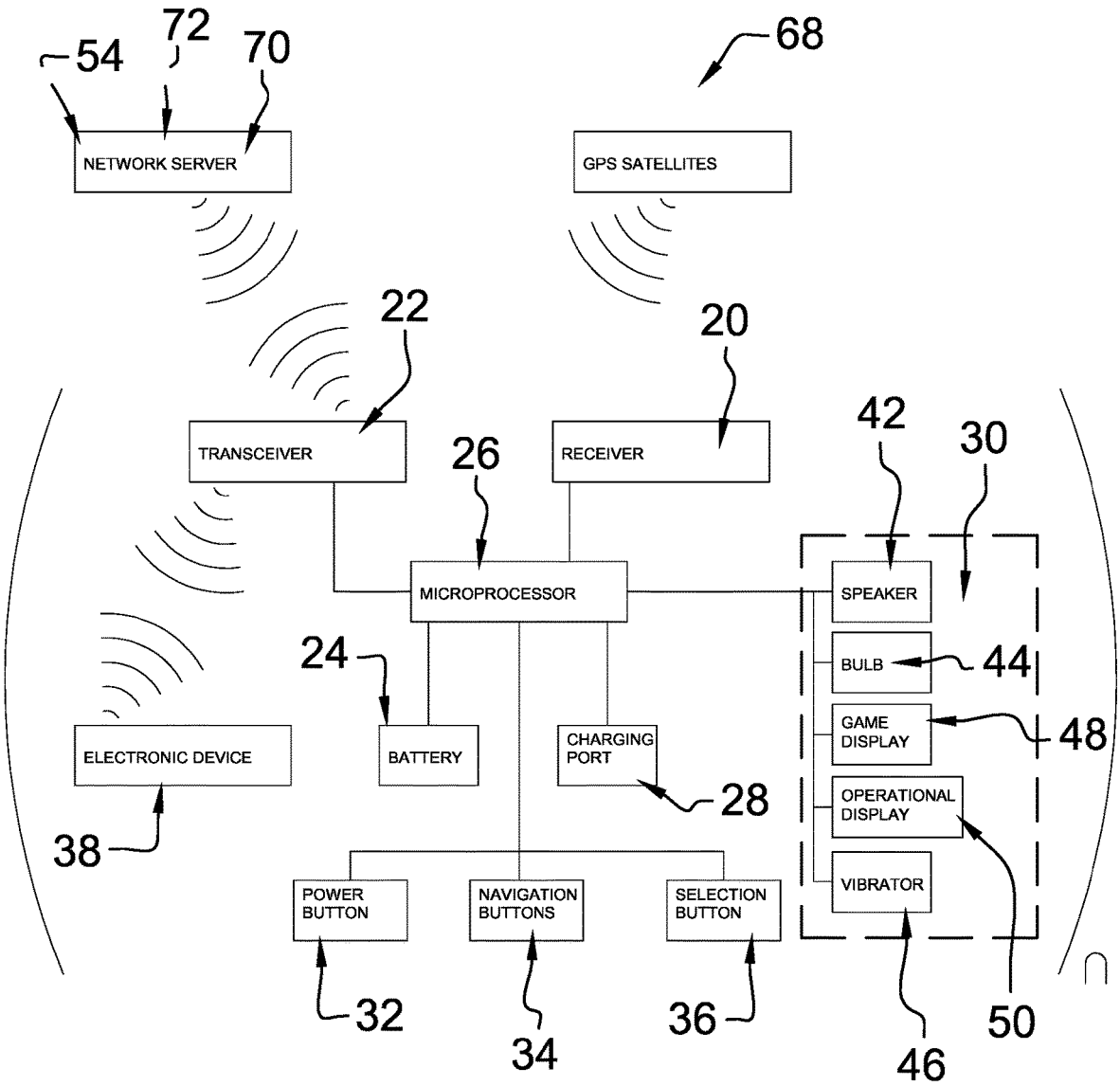
FIG. 5 is a block diagram view of an embodiment of the disclosure.
Figure 6:
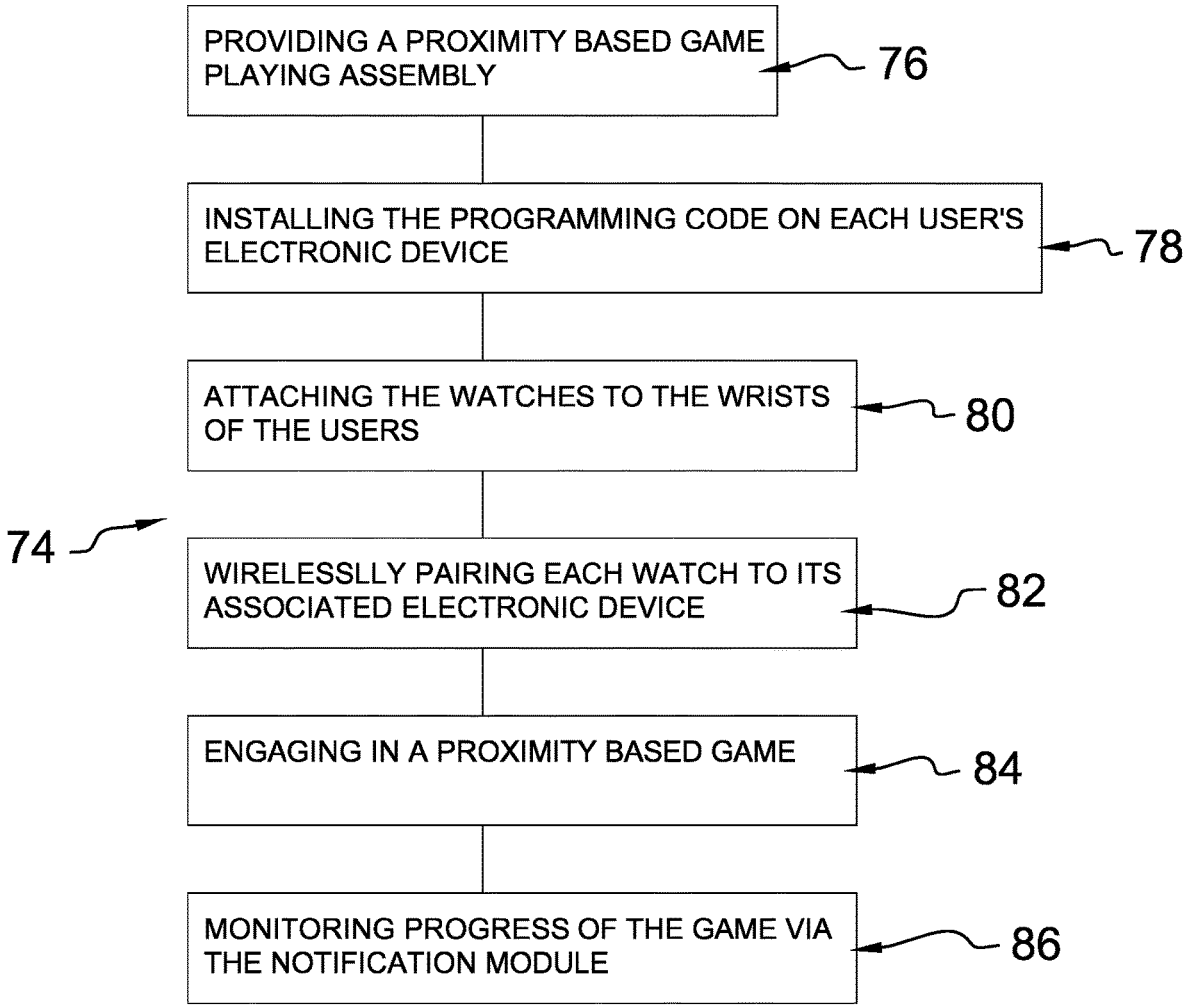
FIG. 6 is a flow diagram for a method utilizing an embodiment of the disclosure.

With reference now to the drawings, and in particular to FIGS. 1 through 6 thereof, a new game playing assembly embodying the principles and concepts of an embodiment of the disclosure and generally designated by the reference numeral 10 will be described.

As best illustrated in FIGS. 1 through 6, the proximity based game playing assembly 10 generally comprises a plurality of watches 12. Each watch 12 comprises a band 14, to which is attached a housing 16 that defines an interior space 18. The band 14 is configured to attach the watch 12 to a wrist of a respective user of a plurality of users who are participating in a proximity based game. The band 14 is length adjustable to fit the wrist of the respective user. A receiver 20, a transceiver 22, a watch battery 24, and a microprocessor 26 are attached to the housing 16 and are positioned in the interior space 18. A charging port 28, a notification module 30, a power button 32, a pair of navigation buttons 34, and a selection button 36 are attached to the housing 16. The microprocessor 26 is operationally engaged to the receiver 20, the transceiver 22, the watch battery 24, the charging port 28, the notification module 30, the power button 32, the pair of navigation buttons 34, and the selection button 36.

The receiver 20 is Global Positioning System (GPS) enabled and the transceiver 22 is configured to wirelessly pair with an electronic device 38, such as a cellphone, that is in possession of the respective user. The watch battery 24 is rechargeable via a charging port 28, which may comprise a Universal Serial Bus port 40, or other connecting means, such as, but not limited to, sockets for barrel connectors, or the like. The charging port 28 is configured for selective insertion of a plug 88 of a charging cord 90 to charge the watch battery 24.

The notification module 30 is configured to notify the respective user of at least one aspect of the proximity based game. The notification module 30 comprises one or more of a speaker 42, a bulb 44, a vibrator 46, a game display 48, and an operational display 50. The speaker 42 is configured to broadcast an audio signal corresponding to an aspect of the proximity based game. The bulb 44 can be selectively illuminated to visually notify the respective user of an aspect of the proximity based game. The bulb 44 may comprise at least one light emitting diode 52 that is configured to emit a plurality of colors. The vibrator 46 selectively vibrates to notify the respective user of an aspect of the proximity based game. The game display 48 is configured to display a name of the proximity based game. The operational display 50 is configured to display a menu of the proximity based games, a status of the transceiver 22, and a charge state of the watch battery 24.

The also anticipates the power button 32 comprising other switching means, such as switches, toggles, or the like. The pair of navigation buttons 34 allows for navigation up and down the menu of the proximity based games, and the selection button 36 is used to select a proximity based game from the menu. The present invention anticipates a touch display (not shown) fulfilling the functions of the game display 48, the operational display 50, the navigation buttons 34, and the selection button 36, as will be apparent to one skilled in the art of electronic controllers.

Programming code 54, which is selectively positionable on the electronic device 38 of each user, enables the electronic devices 38 to receive the GPS coordinates for, and to calculate distances between, the watches 12 of the users. The programming code 54 also enables the electronic devices 38 to determine an outcome based on one or more of the distances, and to signal the notification modules 30 to notify the users of the outcome.

The proximity based game playing assembly 10 also may comprise a football 56. A ball receiver 58, which is GPS enabled, a ball battery 60, which is rechargeable, and a computer processor 62 are attached to and are positioned in the football 56. A signal button 64 and a charger port 66 are attached to the football 56. The computer processor 62 is operationally engaged to the ball transceiver 22, the ball battery 60, the signal button 64, and the charger port 66. The signal button 64 is configured to be depressed in by a digit of a hand of a user, for example, three quick depressions, to signal the computer processor 62 to actuate the ball receiver 58. The charger port 66, which may comprise a Universal Serial Bus port 40, or other connecting means, such as, but not limited to, sockets for barrel connectors, or the like, is configured for selective insertion of a plug 88 of a charging cord 90 to charge the ball battery 60.

The programming code 54 enables assignment of the users to a pair of teams and to determine possession of the football 56 by a respective user of one team based on a distance between the watch 12 of the respective user and the football 56. The programming code 54 also enables calculation of distances between the watch 12 of the respective user in possession of the football 56 and users on the other team. The distances are used to determine a tagging event. The programming code 54 enables signaling of the notification modules 30 to notify the users of the tagging event. The present invention also anticipates the programming code 54 enabling determination of a change in possession of the football 56, as may occur in event of a fumble or interception.

The present invention anticipates a proximity based game playing system 68, which comprises a plurality of watches 12, as described above, and a network server 70. The programming code 54 is positioned on the network server 70 and is selectively transmittable to the electronic device 38 of each user. The programming code 54 enables the electronic device 38 to receive the GPS coordinates for, and to calculate distances between, the watches 12 of the users, to determine an outcome based on one or more of the distances, and to signal the notification modules 30 to notify the users of the outcome.

The present invention also anticipates the proximity based game playing system 68 comprising software 72, which is positioned on the network server 70 and which enables the network server 70 to assign a plurality of users at a plurality of locations to a plurality of teams, to track progress of a proximity based game played concurrently by all users of the plurality of users, and to signal the notification modules 30 to notify the users of an outcome of the proximity based game.

The present invention also anticipates the proximity based game playing system 68 including a football 56, as described above. The software 72 is anticipated to enable assignment of the users to a pair of teams, to determine possession of the football 56 by a respective user of one team based on a distance between the watch 12 of the respective user and the football 56, to calculate distances between the watch 12 of the respective user and watches 12 of users on the other team, to determine a tagging event based the distances, and to signal the notification modules 30 to notify the users of the tagging event. Effectively, the network server 70 would be taking on many of the computing functions that would have been performed on the electronic devices 38 of the users.

The capabilities of the proximity based game playing assembly 10 and the proximity based game playing system 68 are best understood by way of example. In a first example, wherein the proximity based game is a "tag, you are it" type game, the outcome is a user who is "it" tagging a second user. The tagging outcome is determined by calculating the distance between the watch 12 of the user who is "it" and the watch 12 of the second user. If the distance is equal to or less than a predetermined distance, such as the length of one's arm, then the second player is considered tagged. The watches 12 of the user and the second player may broadcast that the second player has been tagged, may vibrate to indicate that the second player has been tagged, or both.

In a second example, the proximity based game is a team tag type game with users located in different locations. For example, with users in parks located in different cities and playing a team "tag, you are it" type game, the proximity based game playing system 68 is required. The network server 70 would assign team membership to, for example, a blue team, a green team, and a yellow team, in substantially equal numbers at each location. Team membership may be indicated in the notification modules 30 via selective illumination of the at least one light emitting diode 52 in a color corresponding to the team. The network server 70 would randomly select a team to be "it". For instance, with the yellow team being "it", yellow team members at all locations would attempt to tag members of the blue team and the green team. When either the green team or blue team has had, for example, 50% of its members tagged, then that team would be "it".

A variety of other proximity based games, such as, but not limited to, freeze tag, tunnel tag, bold tag, alternative tag, band aid tag, elbow tag, turtle tag, toilet tag, Mr. Fox, shipwreck, and the like, are anticipated to be enabled by the proximity based game playing assembly 10 and the proximity based game playing system 68.

In use, the proximity based game playing assembly 10 enables a method of playing a proximity based game 74. The method 74 comprises a provision step 76, which entails providing a proximity based game playing assembly 10, according to the specification above. A first setup step 78 of the method 74 is installing the programming code 54 on each user's electronic device 38. A second setup step 80 of the method 74 is attaching the watches 12 to the wrists of the users. A third setup step 82 of the method 74 is wirelessly pairing each watch 12 to its associated electronic device 38. A first use step 84 of the method 74 is engaging in a proximity based game. A second use step 86 of the method 74 is monitoring progress of the game via the notification module 30.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A proximity based game playing assembly comprising:

a plurality of watches, each watch comprising:

a band configured for attaching the watch to a wrist of a respective user of a plurality of users participating in a proximity based game, a housing attached to the band and defining an interior space, a receiver attached to the housing and positioned in the interior space, the receiver being Global Positioning System (GPS) enabled, a transceiver attached to the housing and positioned in the interior space, the transceiver being configured for wireless pairing with an electronic device in possession of the respective user, and a notification module attached to the housing and being configured for notifying the respective user of at least one aspect of the proximity based game, a microprocessor attached to the housing and positioned in the interior space, the microprocessor being operationally engaged to the receiver, the transceiver, and the notification module; and programming code selectively positionable on the electronic device of each respective user enabling the electronic device for receiving GPS coordinates for, and calculating distances between, the watches, for determining an outcome based on one or more of the distances, and for signaling the notification module of each watch for notifying the users of the outcome.

2. The proximity based game playing assembly of claim 1, wherein the band is length adjustable to fit the wrist of the respective user.

3. The proximity based game playing assembly of claim 1, further including:

a watch battery attached to the housing, positioned in the interior space, the watch battery being rechargeable;

a charging port attached to the housing; and the microprocessor being operationally engaged to the watch battery and the charging port, wherein the charging port is configured for selective insertion of a plug of a charging cord for charging the battery.

4. The proximity based game playing assembly of claim 1, wherein the notification module comprises one or more of:

a speaker configured for broadcasting an audio signal corresponding to an aspect of the proximity based game;

a bulb configured for selectively illuminating for visually notifying the respective user of an aspect of the proximity based game;

a vibrator configured for selectively vibrating for notifying the respective user of an aspect of the proximity based game;

a game display configured for displaying a name of the proximity based game; and an operational display configured for displaying a menu of the proximity based games, a status of the transceiver, and a charge state of the watch battery.

5. The proximity based game playing assembly of claim 4, wherein the bulb comprises at least one light emitting diode configured for emitting a plurality of colors.

6. The proximity based game playing assembly of claim 4, further including:

a power button attached to the housing;

a pair of navigation buttons attached to the housing;

a selection button attached to the housing; and the microprocessor being operationally engaged to the power button, the pair of navigation buttons, and the selection button.

7. The proximity based game playing assembly of claim 1, further including:

a football;

a ball transceiver attached to and positioned in the football, the ball transceiver being GPS enabled;

a computer processor attached to and positioned in the football, the computer processor being operationally engaged to the ball transceiver;

a signal button attached to the football and operationally engaged to the computer processor, wherein the signal button is configured for depressing in by a digit of a hand of a user for signaling the computer processor for actuating the ball transceiver; and the programming code enabling assignment of the plurality of users to a pair of teams, for determining possession of the football by a respective user of one team based on a distance between the watch of the respective user and the football, for calculating distances between the watch of respective user and users on an other team, for determining a tagging event based the distances calculated, and for signaling the notification module of each watch for notifying the users of the tagging event.

8. The proximity based game playing assembly of claim 7, further including:

a ball battery attached to and positioned in the football, the ball battery being rechargeable;

a charger port attached to the football; and the computer processor being operationally engaged to the ball battery and the charger port, wherein the charger port is configured for selective insertion of a plug of a charging cord for charging the ball battery.

9. The proximity based game playing assembly of claim 1, further including:

the band being length adjustable to fit the wrist of the respective user;

a watch battery attached to the housing, positioned in the interior space, the watch battery being rechargeable;

a charging port attached to the housing, wherein the charging port is configured for selective insertion of a plug of a charging cord for charging the watch battery;

the notification module comprising one or more of:

a speaker configured for broadcasting an audio signal corresponding to an aspect of the proximity based game, a bulb configured for selectively illuminating for visually notifying the respective user of an aspect of the proximity based game, the bulb comprising at least one light emitting diode configured for emitting a plurality of colors, a vibrator configured for selectively vibrating for notifying the respective user of an aspect of the proximity based game, a game display configured for displaying a name of the proximity based game, and an operational display configured for displaying a menu of the proximity based games, a status of the transceiver, and a charge state of the watch battery;

a power button attached to the housing;

a pair of navigation buttons attached to the housing;

a selection button attached to the housing; and the microprocessor being operationally engaged to the power button, the pair of navigation buttons, the selection button, the battery, and the charging port.

10. The proximity based game playing assembly of claim 9, further including:

a football;

a ball transceiver attached to and positioned in the football, the ball transceiver being GPS enabled;

a computer processor attached to and positioned in the football, the computer processor being operationally engaged to the ball transceiver;

a signal button attached to the football and operationally engaged to the computer processor, wherein the signal button is configured for depressing in by a digit of a hand of a user for signaling the computer processor for actuating the ball transceiver;

the programming code enabling assignment of the plurality of users to a pair of teams, for determining possession of the football by a respective user of one team based on a distance between the watch of the respective user and the football, for calculating distances between the watch of respective user and users on an other team, for determining a tagging event based the distances, and for signaling the notification module of each watch for notifying the users of the tagging event;

a ball battery attached to and positioned in the football, the ball battery being rechargeable;

a charger port attached to the football; and the computer processor being operationally engaged to the ball battery and the charger port, wherein the charger port is configured for selective insertion of a plug of a charging cord for charging the ball battery.

11. A proximity based game playing system comprising:

a network server;

a plurality of watches, each watch comprising:

a band configured for attaching the watch to a wrist of a respective user of a plurality of users participating in a proximity based game, a housing attached to the band and defining an interior space, a receiver attached to the housing and positioned in the interior space, the receiver being Global Positioning System (GPS) enabled, a transceiver attached to the housing and positioned in the interior space, the transceiver being configured for wireless pairing with an electronic device in possession of the respective user, and a notification module attached to the housing and being configured for notifying the respective user of at least one aspect of the proximity based game, a microprocessor attached to the housing and positioned in the interior space, the microprocessor being operationally engaged to the receiver, the transceiver, and the notification module; and programming code positioned on the network server and selectively transmittable to the electronic device of each respective user, the programming code enabling the electronic device for receiving GPS coordinates for, and calculating distances between, the watches, for determining an outcome based on one or more of the distances, and for signaling the notification module of each watch for notifying the users of the outcome.

12. The proximity based game playing system of claim 11, further including software positioned on the network server enabling the network server for the plurality of users at a plurality of locations to a plurality of teams, for tracking progress of the proximity based game played concurrently by all users of the plurality of users, and for signaling the notification module of each watch for notifying the users of an outcome of the proximity based game.

13. The proximity based game playing system of claim 11, further including:

the band being length adjustable to fit the wrist of the respective user;

a watch battery attached to the housing, positioned in the interior space, the watch battery being rechargeable;

a charging port attached to the housing, wherein the charging port is configured for selective insertion of a plug of a charging cord for charging the battery;

the notification module comprising one or more of:

a speaker configured for broadcasting an audio signal corresponding to an aspect of the proximity based game, a bulb configured for selectively illuminating for visually notifying the respective user of an aspect of the proximity based game, the bulb comprising at least one light emitting diode configured for emitting a plurality of colors, a vibrator configured for selectively vibrating for notifying the respective user of an aspect of the proximity based game, a game display configured for displaying a name of the proximity based game, and an operational display configured for displaying a menu of the proximity based games, a status of the transceiver, and a charge state of the battery;

a power button attached to the housing;

a pair of navigation buttons attached to the housing;

a selection button attached to the housing; and the power button, the pair of navigation buttons, the selection button, the battery, and the charging port.

14. The proximity based game playing system of claim 11, further including:

a football;

a ball transceiver attached to and positioned in the football, the ball transceiver being GPS enabled;

a computer processor attached to and positioned in the football, the computer processor being operationally engaged to the ball transceiver;

a signal button attached to the football and operationally engaged to the computer processor, wherein the signal button is configured for depressing in by a digit of a hand of a user for signaling the computer processor for actuating the ball transceiver;

the programming code enabling assignment of the plurality of users to a pair of teams, for determining possession of the football by a respective user of one team based on a distance between the watch of the respective user and the football, for calculating distances between the watch of respective user and users on an other team, for determining a tagging event based the distances calculated, and for signaling the notification module of each watch for notifying the plurality of users of the tagging event;

a ball battery attached to and positioned in the football, the ball battery being rechargeable;

a charger port attached to the football; and the computer processor being operationally engaged to the ball battery and the charger port, wherein the charger port is configured for selective insertion of a plug of a charging cord for charging the ball battery.

15. A method of playing a proximity based game comprising the steps of:

providing a proximity based game playing assembly comprising:

a plurality of watches, each watch comprising:

a band configured for attaching the watch to a wrist of a respective user of a plurality of users participating in the proximity based game, a housing attached to the band and defining an interior space, a receiver attached to the housing and positioned in the interior space, the receiver being Global Positioning System (GPS) enabled, a transceiver attached to the housing and positioned in the interior space, the transceiver being configured for wireless pairing with an electronic device in possession of the respective user, and a notification module attached to the housing and being configured for notifying the respective user of at least one aspect of the proximity based game, a microprocessor attached to the housing and positioned in the interior space, the microprocessor being operationally engaged to the receiver, the transceiver, and the notification module, and programming code selectively positionable on the electronic device of each user enabling the electronic device for receiving GPS coordinates for, and calculating distances between the watches, for determining an outcome based on one or more of the distances, and for signaling the notification module of each watch for notifying the users of the outcome;

installing the programming code on each user's electronic device;

attaching the watches to the wrists of the users;

wirelessly pairing each watch to its associated electronic device;

engaging in a proximity based game; and monitoring progress of the game via the notification module.

* * * * *